US007921968B2

(12) United States Patent
Stanley et al.

(10) Patent No.: US 7,921,968 B2
(45) Date of Patent: Apr. 12, 2011

(54) ELEVATOR TRAFFIC CONTROL INCLUDING DESTINATION GROUPING

(75) Inventors: Jannah A. Stanley, Cromwell, CT (US); Daniel S. Williams, Southington, CT (US); Paul Simcik, Bristol, CT (US); Hideyuki Honma, Chiba-ken (JP); Toshimitsu Mori, Chiba-ken (JP)

(73) Assignee: Otis Elevator Company, Farmington, CT (US)

( * ) Notice: Subject to any disclaimer, the term of this patent is extended or adjusted under 35 U.S.C. 154(b) by 752 days.

(21) Appl. No.: 11/817,836

(22) PCT Filed: Dec. 20, 2005

(86) PCT No.: PCT/US2005/046216

§ 371 (c)(1),
(2), (4) Date: Sep. 5, 2007

(87) PCT Pub. No.: WO2006/101553

PCT Pub. Date: Sep. 28, 2006

(65) Prior Publication Data

US 2008/0245618 A1 Oct. 9, 2008

(51) Int. Cl.
*B66B 1/16* (2006.01)

(52) U.S. Cl. ..... 187/388; 187/383

(58) Field of Classification Search ..... 187/247, 187/380–388, 391–393

See application file for complete search history.

(56) References Cited

U.S. PATENT DOCUMENTS

| | | | | |
|---|---|---|---|---|
| 3,648,805 | A | 3/1972 | Suozzo et al. | |
| 3,732,950 | A | 5/1973 | Savino | |
| 4,531,616 | A | 7/1985 | Uetani et al. | |
| 4,691,808 | A | 9/1987 | Nowak et al. | |
| 4,782,921 | A | 11/1988 | MacDonald et al. | |
| 4,846,311 | A * | 7/1989 | Thangavelu | 187/383 |
| 4,895,223 | A * | 1/1990 | Ekholm et al. | 187/383 |
| 5,266,757 | A | 11/1993 | Krapek et al. | |
| 5,276,295 | A * | 1/1994 | Kameli | 187/385 |
| 5,317,114 | A * | 5/1994 | Pullela et al. | 187/383 |
| 5,382,761 | A * | 1/1995 | Amano | 187/383 |
| 5,511,634 | A * | 4/1996 | Bahjat et al. | 187/383 |
| 5,511,635 | A * | 4/1996 | Kameli | 187/392 |
| 5,883,343 | A | 3/1999 | MacDonald et al. | |
| 6,065,570 | A | 5/2000 | Friedli et al. | |
| 6,173,816 | B1 | 1/2001 | Barker et al. | |
| 6,394,232 | B1 * | 5/2002 | Iwata et al. | 187/382 |
| 6,991,068 | B2 * | 1/2006 | Siikonen et al. | 187/383 |
| 7,040,458 | B2 * | 5/2006 | Forsythe et al. | 187/396 |
| 7,281,610 | B2 * | 10/2007 | Ylinen et al. | 187/382 |
| 7,735,611 | B2 * | 6/2010 | Tyni | 187/386 |

* cited by examiner

*Primary Examiner* — Jonathan Salata
(74) *Attorney, Agent, or Firm* — Carlson, Gaskey & Olds PC

(57) ABSTRACT

An elevator traffic control technique includes destination grouping that is selectively implemented during selected traffic condition. One example includes determining when up peak traffic conditions exist. If so, the passenger-to-car assignments are grouped based upon the passengers' desired destinations, which are determined before the passengers enter elevator cars, Arranging sectors responsive to current traffic conditions in one example is based upon elevator passenger traffic patterns over the most recent five minutes.

19 Claims, 4 Drawing Sheets

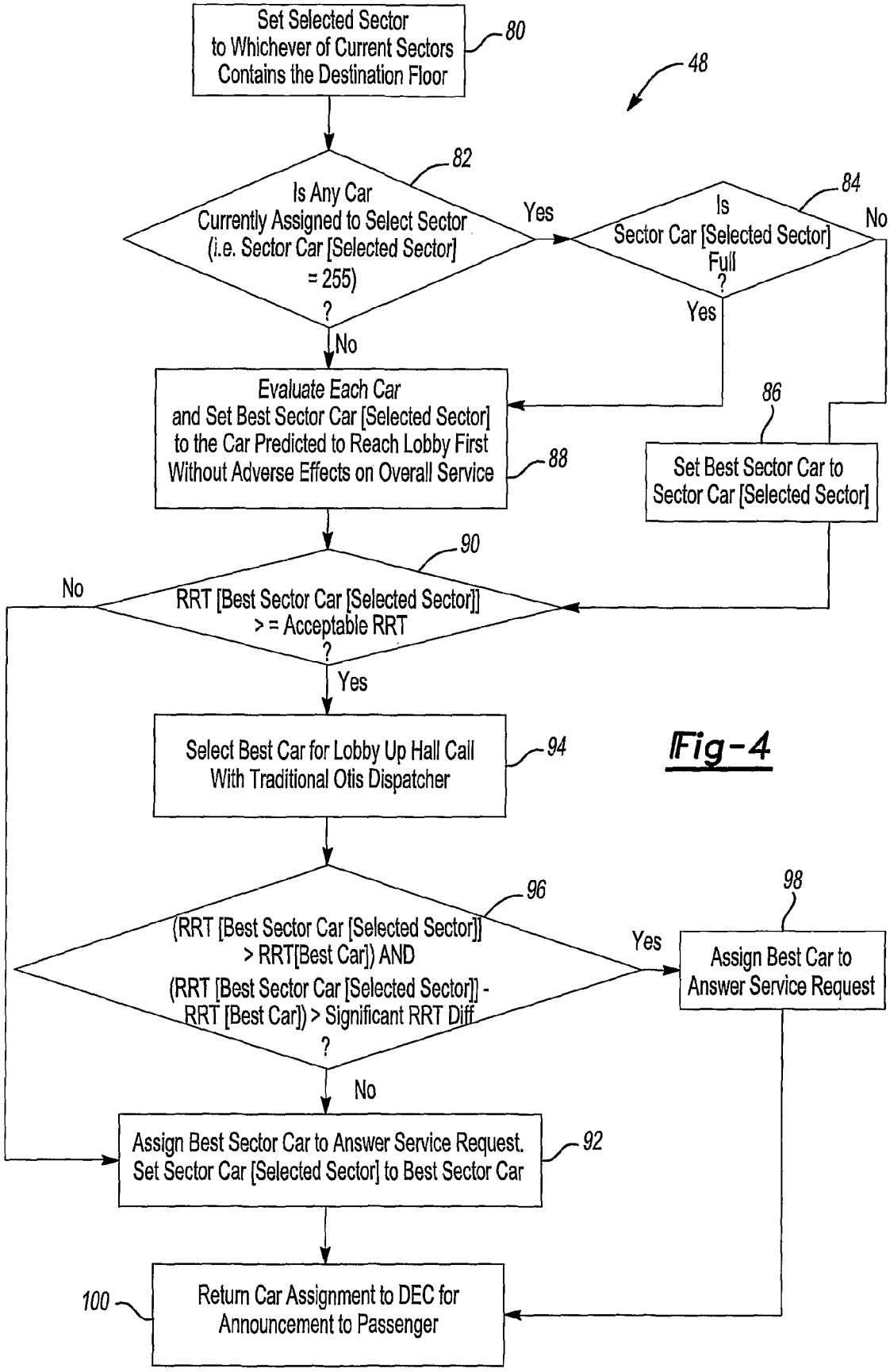
Set Selected Sector to Whichever of Current Sectors Contains the Destination Floor
80
48
Is Any Car Currently Assigned to Select Sector (i.e. Sector Car [Selected Sector] = 255) ?
82
Yes
No
Is Sector Car [Selected Sector] Full ?
84
No
Yes
Evaluate Each Car and Set Best Sector Car [Selected Sector] to the Car Predicted to Reach Lobby First Without Adverse Effects on Overall Service
88
86
Set Best Sector Car to Sector Car [Selected Sector]
RRT [Best Sector Car [Selected Sector]] > = Acceptable RRT ?
90
No
Yes
Select Best Car for Lobby Up Hall Call With Traditional Otis Dispatcher
94
Fig-4
(RRT [Best Sector Car [Selected Sector]] > RRT[Best Car]) AND (RRT [Best Sector Car [Selected Sector]] - RRT [Best Car]) > Significant RRT Diff ?
96
Yes
No
Assign Best Car to Answer Service Request
98
Assign Best Sector Car to Answer Service Request. Set Sector Car [Selected Sector] to Best Sector Car
92
Return Car Assignment to DEC for Announcement to Passenger
100

ELEVATOR TRAFFIC CONTROL INCLUDING DESTINATION GROUPING

FIELD OF THE INVENTION

This invention generally relates to elevators. More particularly, this invention relates to traffic control for elevators.

DESCRIPTION OF THE RELATED ART

Elevator systems are in widespread use for transporting passengers, cargo or both between various levels within a building. Traditional elevator systems rely upon hall call buttons located near an entrance to an elevator where passengers indicate their desire to travel up or down from a current floor. Once the passenger enters the elevator, they use a car operating panel to press a button corresponding to the floor to which they desire to travel.

Such systems have proven effective for many years in many situations. There are scenarios, however, where building populations and passenger traffic patterns require more sophisticated techniques to avoid congestion in building lobbies, to minimize the wait time for a passenger requiring service from the elevator system and to minimize the number of stops an elevator car must make before arriving at a passenger's desired destination. Several techniques have been proposed to address such situations.

One technique is known as destination entry. With such systems, passengers provide an indication of their desired destination before they enter an elevator car. A variety of techniques are known for allowing the passenger to request service to a desired destination. The elevator system uses a scheduling and car assignment algorithm to determine which car will carry that passenger to the desired destination. The passenger is then provided with an indication of the appropriate car that will provide them appropriate service. While destination entry systems can be beneficial, they do not address all needs for elevator traffic control. For example, some destination entry systems simply transfer the congestion of passengers in a lobby area from immediately outside the elevator car doors to the device used for making destination requests.

Another technique is known as channeling. Elevator cars are assigned to serving particular sectors or groups of floors. This technique is believed to minimize the number of stops before arriving at the destinations of passengers within the car, for example. One shortcoming of known channeling systems is that passengers are required to scan display devices located above elevator cars in an attempt to identify the elevator that will travel to their destination. Some such displays are activated ten seconds before the elevator car arrives. This can cause passenger confusion and reduces their confidence that they have determined the appropriate car that will serve their desired destination. Additionally, display devices in known systems are often difficult to read because of lighting conditions. Additionally, such display devices are not always acceptable to building designers or architects.

Another shortcoming of channeling systems is that some elevators wait relatively long times at a lobby level, for example, even though there are no passengers currently requesting destinations within the assigned sector for that car. For example, an elevator car will wait as long as two minutes without any assigned passengers before the car assignment will be changed to another sector. When another sector is very busy, those passengers may experience extended wait times and congestion. The unused elevator car during that time does not alleviate such conditions even though channeling has been implemented.

There is a need for an improved elevator traffic management approach. This invention addresses the need for handling various traffic conditions in an efficient manner.

SUMMARY OF THE INVENTION

An exemplary disclosed method of controlling elevator traffic includes determining a plurality of desired passenger destinations before the passengers enter an elevator car. Passenger-to-car assignments are grouped according to the determined destinations if a selected elevator traffic condition exists.

In one example, the selected elevator traffic condition comprises an up peak traffic condition. One example includes determining that an up peak traffic condition exists by determining a number of desired passenger destinations above a selected originating floor that occur within a selected period of time. One example includes determining a number of desired passenger destinations above a selected originating floor, such as a lobby level, as a percentage of the total number of service requests within a selected time window.

One example includes grouping passenger-to-car assignments such that an elevator car travels to only contiguous desired passenger destinations after departing from an originating floor. This example includes grouping passengers and assigning cars to sectors having floors that are contiguous with each other (e.g., every floor in a sector is immediately adjacent at least one other floor in the sector).

Another example includes grouping the passenger-to-car assignments such that an elevator car trip carries passengers all having the same desired destination. In other words, one example includes grouping passenger-to-car assignments such that an elevator car travels to only one desired passenger destination after departing from the originating floor.

An example embodiment of this invention includes selectively implementing a destination grouping strategy if the selected traffic condition exists. This allows for using other known dispatching algorithms, which may provide the most effective or efficient service for other traffic conditions. Additionally, not every car of an elevator system need be dispatched according to the destination grouping strategy in order to realize the benefits of the disclosed destination grouping technique.

The various features and advantages of this invention will become apparent to those skilled in the art from the following detailed description of a currently preferred embodiment. The drawings that accompany the detailed description can be briefly described as follows.

BRIEF DESCRIPTION OF THE DRAWINGS

FIG. 4 is a flowchart diagram summarizing an example car assignment feature of one embodiment.

DETAILED DESCRIPTION OF THE PREFERRED EMBODIMENT

This invention provides an elevator traffic control technique that includes grouping passenger-to-car assignments according to the passengers' desired destinations, which can be selectively implemented responsive to particular traffic conditions. A disclosed example of destination grouping provides better service to passengers and greater flexibility when dispatching elevator cars to serve passengers during up peak situations.

Figure 1:
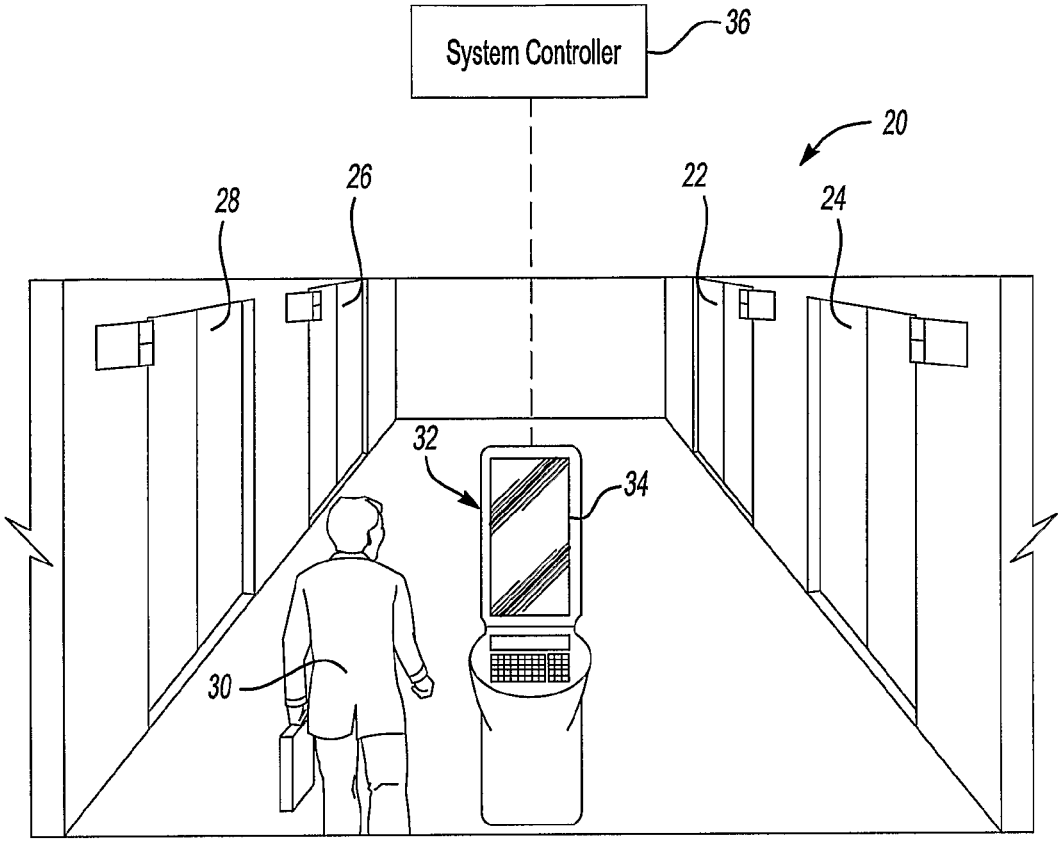
FIG. 1 schematically shows selected portions of an elevator system that utilizes a destination grouping technique designed according to an embodiment of this invention.

FIG. 1 schematically shows selected portions of an elevator system 20. A plurality of elevator cars 22, 24, 26 and 28 are arranged in a known manner to carry passengers 30 between various levels within a building, for example. The illustrated example includes a destination entry device 32 that allows a passenger 30 to provide an indication of their desired destination before the passenger 30 enters one of the elevator cars 22-28. The destination entry device 32 includes a passenger interface 34 that allows the passenger to use a known technique for placing a service request indicating the desired destination. A controller 36 receives the passenger service requests and assigns particular cars 22-28 to carry passengers to their desired destinations. The controller 36 in one example controls the passenger interface 34 to notify the passenger which car has been assigned to their request.

A single controller 36 is schematically shown in the example of FIG. 1 for discussion purposes. Those skilled in the art who have the benefit of this description will realize how many processors or controllers and what combination of software, hardware or firmware will best meet the needs of their particular situation for performing the functions of the example controller 36.

In one example, the controller 36 uses various dispatching algorithms for assigning elevator cars to desired passenger destinations. One example includes selectively using destination grouping for making passenger-to-car assignments based upon the desired passenger destinations. In one example the destination grouping includes assigning cars to sectors or groups of floors that are contiguous with each other. Determining how many sectors and the number of floors within each depends on the desired passenger destinations and the volume of passenger traffic, in one example. In some instances, an elevator car may be assigned for a particular trip to only one destination because all passengers assigned to that car for that trip have the same desired destination. By grouping the passenger-to-car assignments according to the passengers' desired destinations, which are determined before the passengers enter a car, the disclosed example allows for more efficient elevator service especially during particular times of the day when there are unusual traffic loads such as an up peak period.

One example includes determining whether a selected traffic condition exists and utilizing the destination grouping technique during that traffic condition. The illustrated example includes using an up peak traffic condition as the selected traffic condition. Up peak conditions exist when a significant number of passengers are requesting service from a lobby level to a higher level within a building. In one example, the controller 38 is preprogrammed to recognize certain times of the day as corresponding to up peak traffic conditions. Appropriate times of the day can be determined by empirical analysis of elevator traffic within a building over some period of time, for example.

Another example includes determining the number of service requests that are part of up peak traffic and using that number to determine whether up peak conditions exist.

Figure 2:
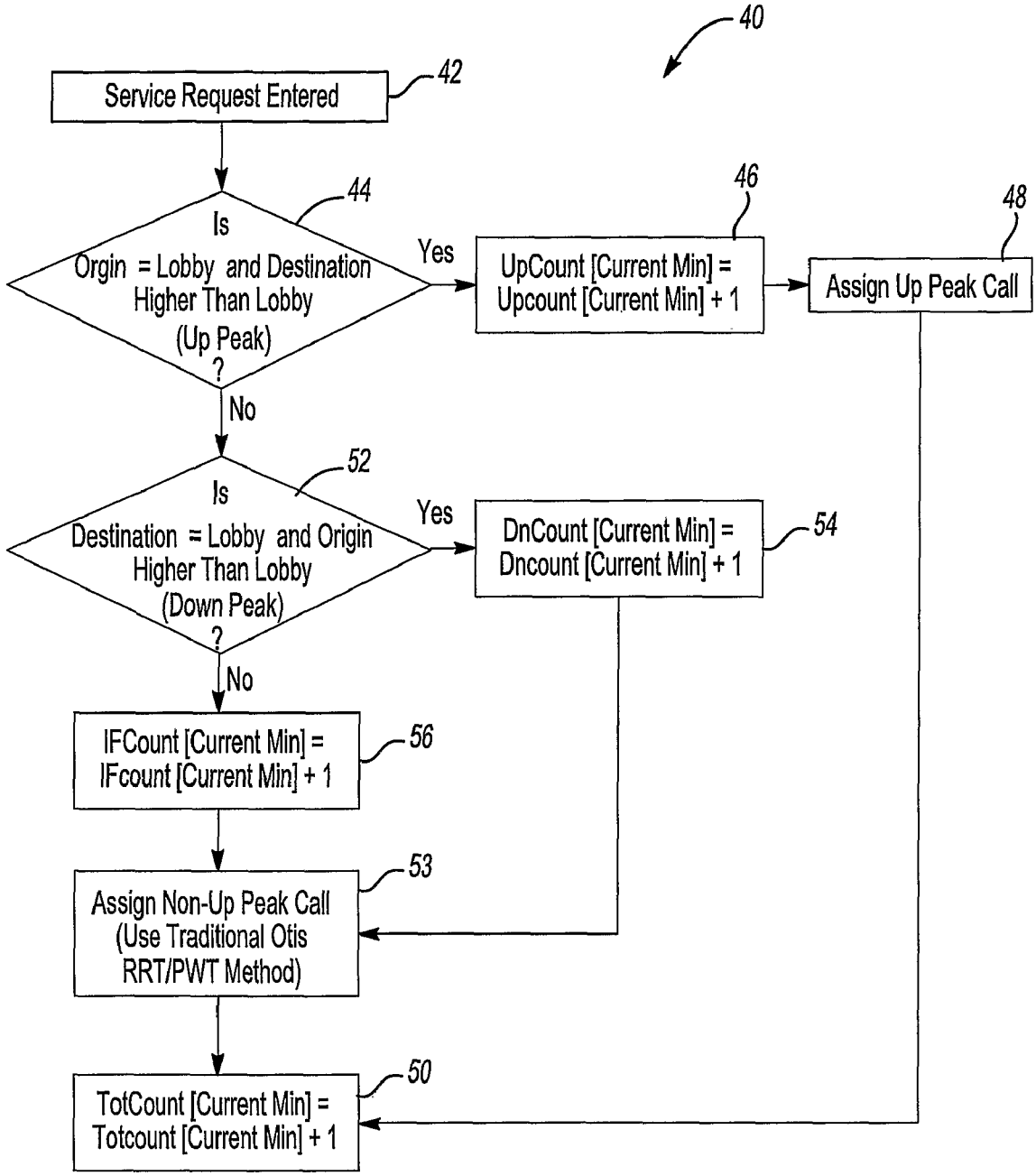
FIG. 2 is a flowchart diagram summarizing a feature of an example embodiment.

FIG. 2 includes a flowchart diagram 40 summarizing one example approach. At 42, the controller 36 determines that a service request has been entered by a passenger 30 using a destination entry device 32. At 44, the controller 36 determines whether a service request is part of up peak traffic by determining whether the request was received at the lobby level and the desired passenger destination is a floor higher than the lobby. When such a request is made, the number of up peak service requests is incremented at 46. At 48, the passenger-to-car assignment is made using destination grouping assuming that up peak traffic conditions exist.

It should be noted that not every request to be carried upward from a lobby level need be accommodated using destination grouping at all times. One example includes only using destination grouping for significant up peak travel conditions. The criteria for what constitutes an up peak traffic condition will vary depending upon building population and elevator system configuration, for example.

In addition to assigning the passenger request to an elevator car at 48, the controller 36 increments a total count of service requests at 50.

Assuming that the service request is not one that would be considered part of up peak traffic, the type of service request is determined at 52. If the request is one that originates at a floor above the lobby and the desired destination is the lobby, then a down travel count is incremented at 54. If the service request is an inter-floor request (i.e., does not originate at the lobby and the lobby is not the desired destination), an inter-floor count is incremented at 56. At 58, the controller 36 uses another dispatching algorithm for assigning the down peak or inter-floor service request to an appropriate elevator car. Known dispatching techniques can be used for service requests other than those within the selected traffic conditions (i.e., non-up peak requests).

One example includes determining up peak conditions based upon the number of service requests to be carried upward from a lobby level within a selected period of time. One example includes considering the traffic conditions based upon the received destination requests during the most recent five minutes. Another example includes considering more than five minutes of recent elevator traffic when deciding whether to implement destination grouping. Such information in one example is used to determine the size and number of sectors or groups used for the destination grouping. One example includes determining the size and location of the sectors for destination grouping using recent levels of up peak traffic, inter-floor traffic and down peak traffic. One example also includes considering the elevator group or system traffic handling capacity during the relevant five minute period in units of number of passengers. This example also includes considering the number of elevator cars available to serve passengers. Considering the relationship between up peak traffic and the elevator system handling capacity within the relevant period of time (e.g., the most recent five minutes) prevents utilizing destination grouping during periods of insignificant, light up peak traffic, for example. One benefit of the disclosed example is that it provides the ability to responsively give priority to demand originating at the lobby without severely adversely affecting passengers requesting service that originates at other floors.

Figure 3:
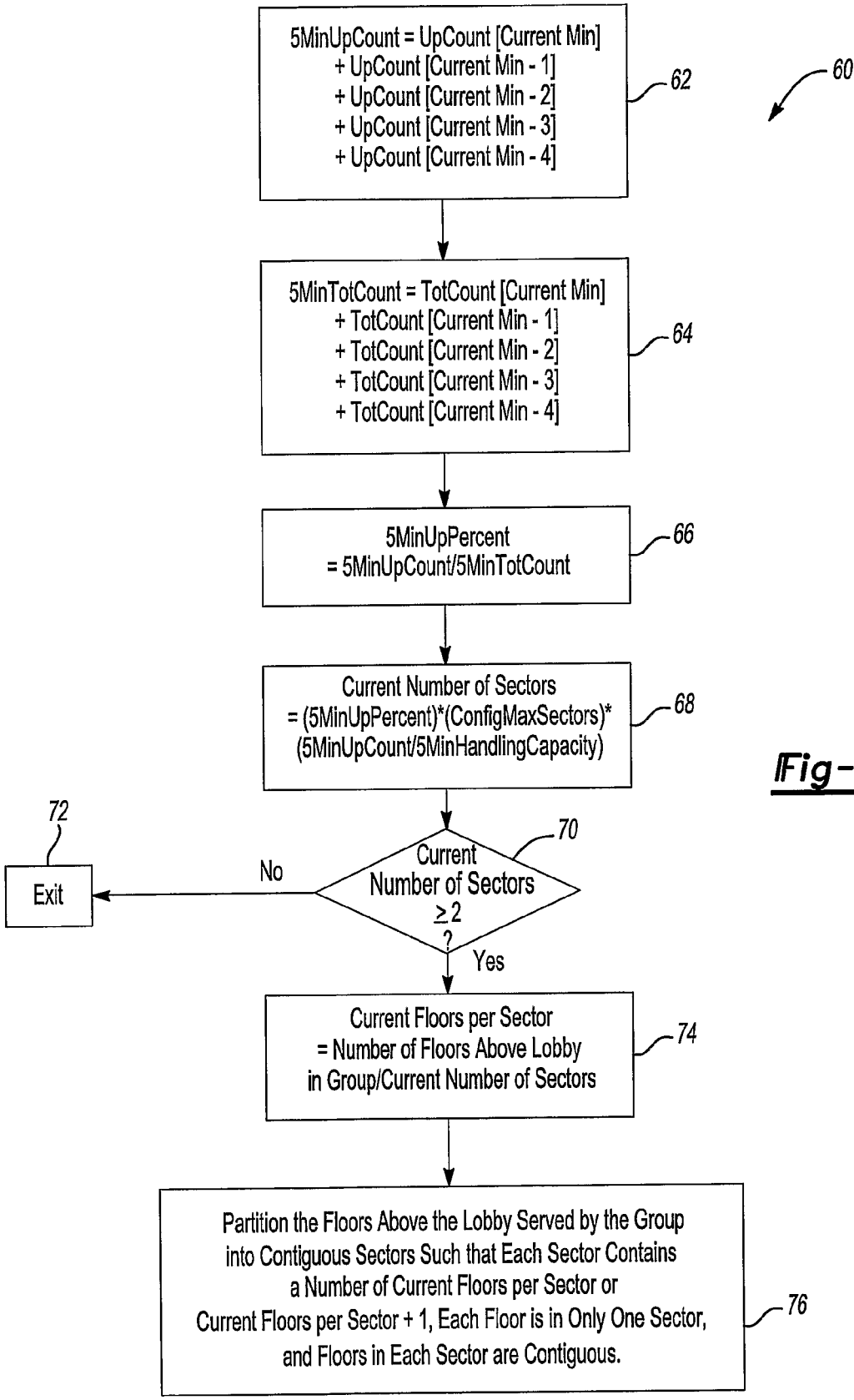
FIG. 3 is a flowchart diagram summarizing another feature of an example embodiment.

As can be appreciated from FIG. 2, for each minute (or another selected time interval) the total number of service requests is determined at 50. The total number of up peak service requests is determined at 46 and the number of down peak service requests is determined at 54. The number of inter floor requests is determined at 56. This service request data for the previous five minutes is analyzed and compared to the five minute handling capacity of the elevator system to determine whether the destination grouping algorithm should be activated. FIG. 3 includes a flowchart diagram 60 that summarizes one example approach of accomplishing this.

At 62, the up peak count for the most recent five minutes is determined based upon information gathered by the controller 36 regarding passenger service requests during those five minutes. At 64, the total count of passenger service requests is determined. At 66, the percentage of up peak traffic to the total amount of traffic is determined.

At 68, the percentage of up peak traffic is used to determine how many sectors to use for the next five minutes. In this example, the current number of sectors is determined by a formula that includes multiplying the percentage of up peak traffic during the last five minutes times the maximum number of sectors, which is based upon the elevator system configuration. The product of those two numbers is then multiplied by the quotient of the five minute up peak count divided by the five minute handling capacity, which is expressed in terms or units of the number of passengers and the number of elevators available to serve the passengers. The result equals the current number of sectors.

At 70, the controller 36 determines whether the value of the current number of sectors determined at 68 is greater than or equal to two. If the percentage of up peak traffic is low enough, the result of the determination made at 68 should indicate that destination grouping is not necessary or desired. In this example, if the current number of sectors is less than two, no destination grouping need be implemented and the controller 36 exits at 72 and continues using another known dispatching algorithm.

If, on the other hand, the percentage of up peak traffic is significant enough, the current number of sectors will be greater than or equal to two. The controller determines how many floors to group in each sector at 74 by dividing the number of floors above the lobby by the current number of sectors determined at 68. In one example, only floors above the lobby that were requested as part of the up peak travel within the relevant preceding five minute period are used for determining the number of floors above the lobby for purposes of determining the current number of floors per sector at 74.

One example includes limiting the maximum number of sectors to keep the number of sectors fewer than the number of cars minus one. This example is useful in systems having larger elevator groups that service less than three times the number of elevator floors above the lobby, for example.

At 76, the controller 36 groups the floors to be served by the appropriate elevator cars into contiguous sectors such that each sector contains floors that are contiguous to each other. In other words, every floor within a sector for the destination grouping in this example is directly adjacent to at least one other floor in that sector. In this example, each sector contains a number of floors that is equal to the current floors per sector determined at 74 or the current floors per sector plus one. In this example, each floor is included in only one sector.

Dividing the floors into sectors in one example includes evenly dividing the floors above the lobby into sectors. In one example where the floors above the lobby used in destination grouping are not evenly divisible into the number of sectors, extra floors are added evenly to some of the sectors. In another example, all extra floors are added to one particular sector such as the highest sector.

Once the controller 36 determines that an up peak traffic condition exists and has arranged the elevator cars into sectors, the destination grouping technique is used to assign a passenger's service request to a particular elevator car as shown at 48 and 52. FIG. 4 includes a flowchart diagram summarizing one example approach for assigning an elevator car to a passenger request. In this example, the controller 36 sets a selected sector to the appropriate sector from a current set of sectors that includes the desired destination floor at 80. This information is used at 82 to determine whether any car is currently assigned to the selected sector. Assuming that the destination request is part of a sector having a car assigned to it, the controller determines at 84 whether a first car assigned to that sector is full. Assuming that first car does not have so many requests assigned to it that it could carry another passenger, at 86 the controller 36 designates the first car in the selected sector as a best sector car.

If there is no car currently assigned to a sector that includes a desired destination or if the first car of the selected sector is full, at 88 the controller 36 evaluates other cars (starting with others in the same sector as the first car) and designates the car predicted to reach the lobby first without adverse effects on overall service as the best sector car. One example includes reserving at least one car to be assigned to a sector that does not include any currently pending destination requests. By reserving a car for such a sector, this example ensures that a car is always available to quickly service a request for such a sector.

Once the best sector car is set, a decision is made at 90 whether the amount of time (in seconds, for example) that it will take for the best sector car to reach the lobby is compared to an acceptable amount of time for a passenger to wait in the lobby for up peak service. If the best sector car is expected to arrive at the lobby within a sufficiently short period of time, the passenger-to-car assignment is made assigning the best sector car to that request. This is accomplished at 92 in the example of FIG. 4.

Assuming that the car currently designated the best sector car will not arrive at the lobby within a sufficiently short period of time, the controller 36 uses another dispatching algorithm at 94 to designate a different car as a best car for serving that particular request. The controller 36 determines whether the car designated as the best car or the car designated as the best sector car will provide the best service. In the example of FIG. 4, at 96 a decision is made whether the expected arrival time of the best sector car is later than the expected arrival time of the best car and whether a difference between the expected arrival time of the best sector car and the expected arrival time of the best car is greater than a selected threshold indicating a significant difference. One example includes 30 seconds as a significant difference between the expected arrival times of the two cars designated as the best sector car and the best car, respectively. If the determination made at 96 is positive, then the car designated the best car is assigned at 98 to service that request. If the determination made at 96 is negative, then the controller 36 proceeds at 92 to make the passenger-to-car assignment such that the car designated the best sector car services that request.

One example includes considering the average time between service requests for destinations in a sector and the expected number of passengers to board a car at the lobby to determine whether to extend the door time for that car serving the up peak call at the lobby. In one example, if it appears likely that additional destination requests for a particular sector will be received within the next few seconds and the elevator car has enough spare capacity to load more passengers, the wait time of that car at the lobby may be extended to accommodate such additional passengers.

Once the car assignment is made, the controller 36 controls the passenger interface 34 at 100 to notify the passenger which car will carry them to their desired destination. This notification may be visible, audible or a combination of them.

The disclosed example provides advantages over previous elevator traffic control techniques. Utilizing destination grouping responsive to the passengers' destination requests reduces the in car time of passengers but does not have the drawbacks associated with typical channeling systems. The disclosed example minimizes the average highest call reversal position, which allows elevator cars to return to the lobby quicker. This enhances the overall traffic capacity of the system during times where up peak travel demand exists, for example. Another advantage to the disclosed example is that passengers do not need extra knowledge to interact with the system. Whether the destination grouping algorithm is used to assign a car to a passenger request is invisible to the passenger.

The disclosed example also has the advantage of not wasting time assigning sectors for which there is no demand, which otherwise occurs with traditional channeling arrangements. Additionally, when a car assigned to a sector is delayed, the delay does not affect future up peak service requests for that sector. This is due, at least in part, to the rearrangement of sectors based upon the most recent five minutes of traffic. In one example, the evaluation of whether to use destination grouping and the sector assignments for that are determined every minute.

The disclosed example also has the advantage of avoiding degrading service for inter-floor and down peak passengers when the destination grouping algorithm is implemented for handling up peak traffic.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling elevator traffic, comprising:

determining a plurality of desired passenger destinations before the passengers enter an elevator car; and grouping passenger-to-car assignments according to the determined destinations if a selected elevator traffic condition exists and such that an elevator car travels to only one desired passenger destination after departing from an originating floor.

2. The method of claim 1, wherein the selected traffic condition comprises an up peak traffic condition.

3. The method of claim 2, comprising determining that the up peak traffic condition exists by determining a number of desired passenger destinations above a selected originating floor within a selected period of time.

4. The method of claim 2, comprising determining that the up peak traffic condition exists by determining a time of day.

5. The method of claim 1, comprising grouping the passenger-to-car assignments such that an elevator car travels to only contiguous desired passenger destinations after departing from an originating floor.

6. The method of claim 1, comprising grouping the passenger-to-ear assignments within a plurality of sectors such that at least one elevator car travels to each sector and each floor from the determined plurality of desired passenger destinations is included in only one sector.

7. The method of claim 1, comprising determining at least one characteristic of elevator traffic during a recent time interval having a selected duration; and determining a size and a number of sectors for grouping the passenger-to-car assignments based on the at least one determined characteristic.

8. The method of claim 7, including determining the elevator system capacity and using the determined capacity for determining the size and number of sectors.

9. A method of controlling elevator traffic, comprising:

determining a plurality of desired passenger destinations before the passengers enter an elevator car;

grouping passenger-to-car assignments according to the determined destinations if a selected elevator traffic condition exists;

determining a first number of requests corresponding to desired passenger destinations in an up direction from an originating floor, a second number of requests corresponding to desired passenger destinations in a down direction toward the originating floor and a third number of requests corresponding to desired passenger destinations corresponding to travel between floors above the originating floor, respectively, within a selected time interval; and determining if the selected elevator traffic condition exists based on the determined number of requests and the elevator system capacity for the selected time interval.

10. A method of controlling elevator traffic, comprising:

determining a plurality of desired passenger destinations before the passengers enter an elevator car;

grouping passenger-to-car assignments according to the determined destinations if a selected elevator traffic condition exists;

determining a maximum number of sectors based upon a configuration of a corresponding elevator system;

determining a number of requests corresponding to the plurality of determined desired passenger destinations during a selected time interval corresponding to up peak traffic;

determining a handling capacity of the corresponding elevator system during the selected time interval;

determining a number of elevators from the corresponding elevator system available to serve the passengers;

determining a percentage of up peak traffic requests from the determined number of requests from the selected time interval; and determining a current number of sectors to be used if the selected elevator traffic conditions exists by multiplying the determined percentage of up peak traffic times the determined maximum number of sectors multiplied by the determined number of requests corresponding to up peak traffic divided by the determined handling capacity.

11. The method of claim 10, comprising determining whether the determined current number of sectors exceeds a threshold wherein the selected elevator traffic condition exists when the determined current number of sectors exceeds the threshold.

12. The method of claim 11, comprising determining how many floors to group into each of the current sectors by dividing the number of floors above an origination floor by the determined current number of sectors.

13. The method of claim 12, comprising evenly dividing the floors above the origination floor into sectors if the number of floors above the origination floor are evenly divisible into the determined current number of sectors.

14. The method of claim 10, comprising restricting the maximum number of sectors to a number less than the determined number of elevator cars.

15. A method of controlling elevator traffic, comprising:

determining a plurality of desired passenger destinations before the passengers enter an elevator car;

grouping passenger-to-car assignments according to the determined destinations if a selected elevator traffic condition exists;

selecting a sector from a current set of sectors that includes a determined desired passenger destination;

determining whether an elevator car is currently assigned to the selected sector;

determining whether a first car assigned to the selected sector has capacity to service a request for the desired passenger destination; and designating the first car in the selected sector as a best sector car if the first car has the capacity.

16. The method of claim 15, comprising determining which one of a plurality of available elevator cars will reach the origination floor first;

designating the determined car as the best sector car if the first car does not have the capacity to service the request for the desired passenger destination.

17. The method of claim 16, comprising determining an amount of time it will take for the designated best sector car to reach the origination floor;

determining whether the determined amount of time exceeds an acceptable wait time threshold; and assigning the request for the desired passenger destination to the designated best sector car if the determined amount of time is less than the acceptable wait time threshold.

18. The method of claim 17, comprising designating a different car as a best car for serving the request for the desired passenger destination if the determined amount of time exceeds the acceptable wait time threshold; and determining whether a difference in arrival time at the origination floor of the designated best sector car and the designated best car exceeds a selected threshold if the arrival time of the designated best car is earlier than the arrival time of the designated best sector car; and assigning the request for the desired passenger destination to the designated best car if the determined difference exceeds the selected threshold.

19. A method of controlling elevator traffic, comprising:

determining a plurality of desired passenger destinations before the passengers enter an elevator car;

grouping passenger-to-car assignments according to the determined destinations if a selected elevator traffic condition exists;

determining an average time between requests for at least some of the determined plurality of desired passenger destinations that are all within a single sector;

determined an expected number of passengers to board an elevator car at an origination floor; and extending a wait time for the elevator car at the origination floor if the determined average time indicates that another desired passenger destination request will be received for that sector within a selected time interval and the elevator car has capacity to receive at least one more passenger.

* * * * *